United States Patent [19]

Palmer

[11] Patent Number: 4,691,758

[45] Date of Patent: Sep. 8, 1987

[54] TWO-DRUM, TWO-LAYER CONTINUOUS MELD-CASTING METHOD

[76] Inventor: Forrest M. Palmer, 31 Towhee Rd., Hilton Head, S.C. 29928

[21] Appl. No.: 859,070

[22] Filed: May 2, 1986

Related U.S. Application Data

[63] Continuation-in-part of Ser. No. 540,834, Oct. 11, 1983, abandoned.

[30] Foreign Application Priority Data

Oct. 11, 1984 [JP] Japan ..... 59-213242

[51] Int. Cl.[4] ..... B22D 11/00; B22D 19/14

[52] U.S. Cl. ..... 164/461; 164/480; 164/483

[58] Field of Search ..... 164/97, 427, 428, 437, 164/461, 479, 480, 488, 483

[56] References Cited

U.S. PATENT DOCUMENTS

| | | | |
|---|---|---|---|
| 2,128,942 | 9/1938 | Hudson | 164/419 |
| 2,450,428 | 10/1948 | Hazelett | 164/428 |
| 2,693,012 | 11/1954 | Harris et al. | 164/428 |
| 3,428,111 | 2/1969 | Gyongos et al. | 164/488 |
| 3,838,997 | 10/1974 | Becker et al. | 164/128 |
| 3,976,117 | 8/1976 | Olsson | 164/461 |

FOREIGN PATENT DOCUMENTS

| | | | |
|---|---|---|---|
| 0863820 | 2/1971 | Canada | 164/461 |
| 1354771 | 5/1974 | United Kingdom | 164/497 |
| 0602306 | 4/1978 | U.S.S.R. | 164/97 |

*Primary Examiner*—Nicholas P. Godici
*Assistant Examiner*—Richard K. Seidel
*Attorney, Agent, or Firm*—Parmelee, Bollinger & Bramblett

[57] ABSTRACT

Two-drum, two-layer continuous casting method and apparatus for casting metallic strip from molten metal in which two closely spaced drums with parallel horizontal axes define the bite region between them. The drums are revolved in opposite directions at approximately the same surface speed with the surface of each drum moving downwardly in the bite region. The two drums are hollow and are internally cooled in a manner to keep their external surfaces at a temperature in the range from and including 100° C. to 400° C. The molten metal flows in a launder at controlled velocity toward the crest of each revolving drum, and the drum surface is travelling at speed faster than this controlled flow velocity, at least 1.5 times as fast for pulling a thin layer of the metal forward on each drum surface significantly faster than the metal was previously flowing in the launder, thereby significantly thinning the pulled layer of metal as it makes the transition from the slower moving mass in the launder to the faster travelling layer being pulled forward by the drum surface. The thin layer of metal on each drum surface is no more than about 0.15 of an inch thick and is in a liquidous/solidous state. These thin liquidous/solidous layers on the revolving drum surfaces as they are in the process of solidifying are carried down into the bite region between the drums. In the narrowest portion of the bite region the drums have a spacing in the range from 0.01 of an inch to 0.30 of an inch for melding these two solidifying liquidous/solidous layers together in the bite region to form a resulting thin cast strip moving downwardly from the bite region.

17 Claims, 8 Drawing Figures

TWO-DRUM, TWO-LAYER CONTINUOUS MELD-CASTING METHOD

RELATED APPLICATIONS

This application is a continuation-in-part of my prior copending application Ser. No. 540,834, filed Oct. 11, 1983, now abandoned.

BACKGROUND OF THE INVENTION

This invention relates to a method for continous meldcasting of metallic strip, metallic matrix composites and laminated products by melding two thin liquidous/solidous layers together. If desired, reinforcing constituents, such as filaments or whiskers, may be introduced to the molten or solidifying metal. Alternatively solid or reticulated webs or strips of other materials may be introduced to form laminated products in continuous lengths. Additionally, the outer surfaces of the cast strip may be shaped into decorative or useful patterns. The invention also comprises a twodrum machine for producing the two thin liquidous/solidous layers and for melding them together with or without the reinforcing or laminating constituents.

To illustrate the advantages of the present invention aluminum and its alloys will be used as examples of the cast metal although this invention applies to other metals and alloys also.

Existing methods of producing aluminum or aluminum alloy strip start with a cast product from 0.25 of an inch up to 24 inches or more in thickness. If the cast product is over 0.375 of an inch thick, it must be hot rolled to a gauge which can be coiled, typically 0.09 to 0.375 of an inch thick. Such hot rolling equipment usually has a minimum capacity of 100,000 short tons per annum and likely costs more than $50 million. If the cast stock is less than 0.375 of an inch in thickness, it can be cold rolled directly to the required finished gauge. It is normally more economic to cast stock less than 0.375 of an inch in thickness (by continuous casting) and coil it. However, prior art continuous casting processes cannot efficiently cast thicknesses less than 0.25 of an inch. The continuous casting equipment to produce a typical gauge such as 0.30 inch thick stock will likely cost $5 million for a minimum capacity of 10,000 short tons per annum.

Whether starting with a thick ingot and hot rolling or with 0.3 inch thick continuous cast stock, it is necessary to use powerful high capacity cold rolling equipment for reducing the gauge to that required by most users (typically between 0.01 and 0.04 of an inch thick). Such cold rolling equipment typically has a capacity of 50,000 short tons per annum or more and typical facilities cost $50 million dollars. Thus, with existing processes it is impossible to produce the gauges of sheet required for most applications with an expenditure of less than about $55 million.

These existing metal casting processes also introduce many undesirable operating costs. In producing thick ingot much energy and cooling water are wasted during solidification, which energy is then replaced during ingot reheating to achieve the temperatures required for hot rolling. Energy is then additionally wasted when the hot rolled coil is allowed to cool for cold rolling. When continuous casting, energy and water are similarly wasted to the degree that solidification takes place at a gauge greater than that required by the application. For the hot and cold rolling reductions required by such processes it is necessary to use flood lubrication on the rolls. This flood lubrication contains oil and is a substantial environmental hazard and cost.

From the above review of existing casting methods, it is evident that for aluminum and many other metals a great deal of capital and fabricating costs could be saved by casting a strip of thickness closer to the final gauge required by the application.

Other economies occur if the production unit can be reduced in capacity and proportionately in capital cost, without major offsetting losses in production efficiency. Most of the margin between the cost of crude ingot and the delivered price of finished strip or sheet is represented by the sum of factory overheads plus administrative, selling, inventory, distribution and transportation costs. The actual cost of transformation from ingot to strip is typically less than 40% of the margin between ingot and the selling price of strip.

Thus, a low capacity, simple, cost effective, strip producing unit will reduce delivered costs of strip by permitting local production and in-house production of strip and sheet, which are now produced by shipping ingot from a smelter to a large rolling mill and then shipping the rolled product to the user. This principle that costs are dramatically reduced and usage is greatly expanded by local fabrication is illustrated by the history of the aluminum extrusion industry. In the United States, extrusions were produced after World War II by the three primary aluminum smelters plus two or three independent extruders. However, the selfcontained small extrusion press was developed, together with an improved alloy. A press could then be installed for less than $500,000. This feasibility of economical localized presses lead to a rapid expansion of the number of independent extruders so that by 1965 there were over 100. At the same time, there was a great expansion of aluminum extrusion usage which rose from being about 15% of sheet usage to being about 40% of sheet usage.

SUMMARY OF THE DISCLOSURE

The present invention is intended to provide a low capacity, simple, cost effective method and apparatus for making sheet which will permit the wide dispersion of sheet production into smaller centers for in-house or local requirements. This production in smaller, more numerous centers will reduce costs and increase useage.

This production in smaller, more numerous sites is feasible, because the invention will produce cast strip in gauges below 0.25 of an inch down to 0.01 of an inch, which range is below that of other continuous casting processes. Furthermore, this range of thickness covers all commercially existing sheet and strip applications. Also, it is foreseen to continuously cast strip by use of this invention of a width close to that required by the particular commercial application, and the majority of applications require strip less than 30" in width. The lower ascast gauge and the narrower widths which can be as-cast by this invention permit major savings in capital cost without causing offsetting increases in rolling costs.

Examples of aluminum and aluminum alloy sheet applications which can be made with the present invention include aluminum siding and awning stock, gutter and down spout stock, fascia and roofing sheet, damp course (vapor barrier), can stock and lamp base stock, seam welded tubing for furniture and other applications, roll formed profiles including TV antenna tubing, window, door and structural sections, stock for impact extrusion slugs.

Examples of lead or lead alloy sheet applications which can be made with the present invention include wine bottle capping stock, sound proofing sheet, electric storage battery stock. Tin applications include impact extrusion slugs.

As described below, strands or reticulate networks of strands, of suitable metals or ceramics can be introduced easily into the solidifying webs. Metal or ceramic whiskers can also be introduced. Such reinforcing agents increase the tensile strength or the modulus of elasticity or both of the cast, reinforced web far above the strength or modulus of the matrix metal containing them. Such combinations of materials are termed metal matrix composites.

Aluminum metal matrix composites use boron, graphite, silicon carbide, steel and other materials resistant to elevated temperatures, as reinforcing agents. The resulting composite webs are primarily used in the aerospace and aviation industries for structural members to reduce aircraft weight. Such composites are extremely expensive, partly because of the cost of the reinforcing agents, but partly also because of the cost of the existing processes of making them. These processes require a sequence of operations and are batch processes. The present invention will greatly reduce the cost of making such metal matrix composites, because it introduces the reinforcing agent in one step instead of several and is a continuous process. By introducing steel wires or whiskers into an aluminum matrix with the present invention, it is possible to achieve tensile strengths higher than aircraft alloys such as AA7075 and a modulus of elasticity 50 percent or more higher than any existing aluminum alloy. Steel is the cheapest of the available reinforcing agents and the present cheap process for making steel reinforced aluminum matrix composites will open commercial markets for such composites. Examples of commercial applications of steel reinforced aluminum matrix composites include automotive bumpers, highway guard railing, structural tubing and sections. However, aluminum matrix composites containing expensive reinforcing agents such as boron, graphite and ceramics are produced more cheaply with the present invention and will be used more widely in the aerospace and other industries.

Laminated or clad materials are produced by introducing solid or reticulate webs of materials, other than the matrix material, between the two webs being cast. Alternatively other combinations of laminated or clad materials are produced by introducing solid or reticulate webs on the outside of one or both of the webs being cast.

Lead matrix composites reinforced with a steel reticulate web are made with the present invention. Such a product is nonsagging and creep resistant and can be used for sound proofing in vertical walls or in roofing and chemical containers. Copper wire cast into lead battery plates by use of the present invention advantageously reduces the internal resistance of the battery.

An aluminum alloy matrix clad on the outside with high purity aluminum is used for applications requiring a combination of strength and corrosion resistance or brightness, such as light reflectors or trim. Aluminum brazing sheet requires a cladding of an alloy with a lower melting point than that of the matrix alloy.

When the surface of one or both of the two casting drums of the two drum continuous casting apparatus of this invention is engraved with a pattern, then the surface of the respective cast web is shaped to that engraved pattern. By this means decorative patterns are obtained, such as wood grain for aluminum siding. Alternatively, patterns such as reinforcing ribs are produced to increase denting resistance or the moment of inertia of a structural tube or section roll formed from the ribbed sheet.

In accordance with the present invention in one of its aspects, there is provided a method of continuously meld-casting metallic strip from molten metal comprising the steps of providing two closely spaced drums with parallel horizontal axes defining a bite region between them, revolving said drums in opposite directions at approximately the same surface speed with each drum moving downwardly in the bite region, cooling said drums for maintaining the drum surfaces below the solidification temperature of said molten metal, flowing the molten metal in two shallow pools flowing at controlled velocity in each pool, the metal flows being in opposite directions in the respective pools flowing toward each other toward the crest of the respective drum near each shallow pool and with the drum surfaces travelling at least 1.5 times as fast as said controlled velocity for forming thin solidifying layers of liquidous/solidous metal carried from the crests of the respective drums and down toward the bite region, and melding together in the bite region said two solidifying layers forming a resulting melded strip moving downwardly from the bite region below the bite region.

In accordance with the present invention in another of its aspects, there is provided apparatus for continuously meldcasting metallic strip from molten metal comprising a pair of hollow drums, support means for supporting said hollow drums closely spaced with their respective axes parallel and horizontal for defining a bite region between the external surfaces of said drums and for allowing said drums to be revolved about their axes, the closest spacing between the external surfaces of said drums in said bite region being in the range from 0.01 of an inch to 0.3 of an inch, drive means for revolving said drums in opposite directions at approximately the same surface speed with each external surface moving downwardly in said bite region, means for spray mist cooling the internal surfaces of said hollow drums for maintaining their external surface temperature below the solidification temperature of said molten metal, shallow launders for applying molten metal to the external surfaces of said drums at the crests of said drums with the molten metal in the respective launder flowing at controlled velocity in the same direction as the external surface of the adjacent drum at the crest, said drive means revolving said drums with an external surface speed at least 1.5 times said controlled flow velocity for pulling liquidous/solidous metal forward on the crest of the drum for forming thin layers of solidifying metal on the revolving surfaces of the drums for being carried down into the bite region for melding said two layers together into a resultant melded strip travelling downwardly from the bite region.

The reasons for the simplicity advantages and cost effectiveness of the present invention will become more fully understood from the following description and by comparing it with existing continuous casting processes. Such continuous casting processes are themselves more economic than conventional thick ingot casting and rolling processes.

DETAILED DESCRIPTION OF PREFERRED EMBODIMENTS

Figure 1:
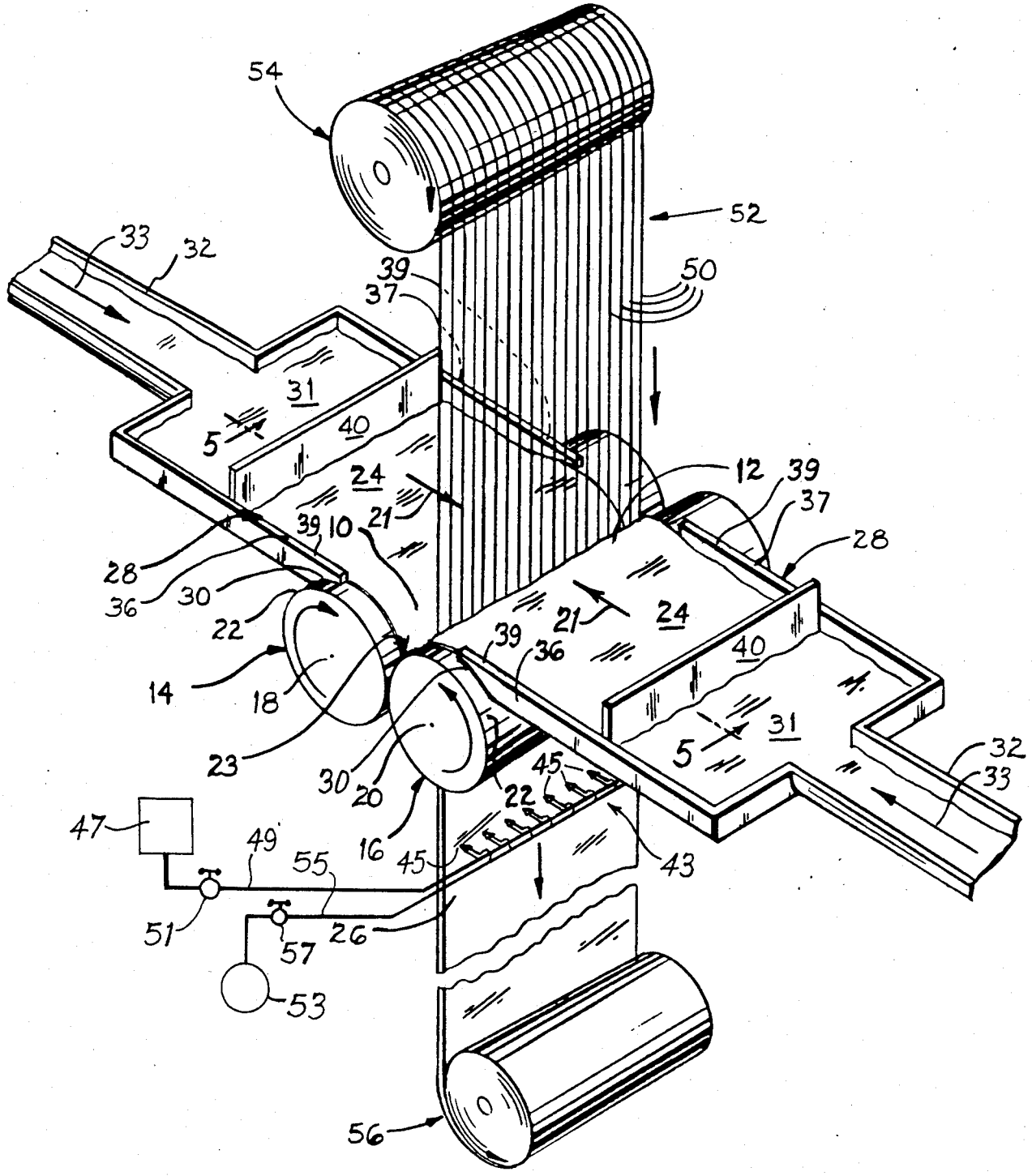
FIG. 1 is a perspective view showing the two-drum, two-layer continuous meld-casting method and apparatus embodying the present invention for producing a meld-cast strip product.

Two layers 10 and 12 (liquidous/solidous layers) are formed simultaneously, each on one of two separate drums 14 and 16 rotating in opposite directions. The drums are mounted with horizontal axes 18 and 20 in the same horizontal plane and with their circumferential surfaces 22 in close proximity. The direction of counter rotation of the drums is such that the proximate circumferential surfaces 22 of the drums are moving vertically downwardly in the bite region 23. The molten metal 24 is supplied flowing at controlled velocity 21 from opposite directions and is flowed onto the circumferential (external) surfaces 22 of both drums with the top surface of the molten metal 24 at a level close to but not more than slightly above the horizontal plane of the crests of the drum surfaces, as will be explained in detail further below. The metal is in a liquidous/solidous state, being in the process of solidifying as it is being carried on the surfaces 22 of the drums on their crests and then downwardly toward the narrowest area 23 between the two drums (commonly called the "bite"). The liquidous/solidous metal solidifying on the two revolving drum surfaces forms the lavers 10 and 12. As these two layers approach the narrowest point of the bite, they are melded together into one unitary meld-cast strip 26 by a combined action of liquidous/solidous metal flowing together and welding together under pressure. The degree of solidification of the two layers 10 and 12 prior to their reaching the bite 23 and hence the melding conditions in the bite are controlled by the speed of rotation of the drums, by their surface temperatures, by the thickness of these two layers 10 and 12, and by the particular metal 24 involved.

In this method and apparatus the narrowest portion of the bite region 23 has a spacing in the range from 0.01 of an inch to 0.3 of an inch. Thus, the resultant integral meld-cast strip 26 can have a thickness in the relatively thin range of 0.01 of an inch to 0.04 of an inch which is required by the majority of commercial applications of aluminum and its alloys. Thicker strip 26, from 0.04 to 0.3 of an inch can also be meld-cast but is in less demand in the market. Applications on this strip 26 are described above in the Summary of the Disclosure.

As mentioned above, the melding conditions of the liquidous/solidous layers 10 and 12 in the bite 23 are controlled by the speed of rotation of the drums, by their external surface temperatures, by the thickness of the two layers 10 and 12 themselves, and by the particular metal involved. When the melded strip 26 has a thickness (gauge) above a predetermined gauge, depending upon the particular metal being cast, for example with a gauge of strip 26 above about 0.15 to about 0.20 of an inch in the case of aluminum and its alloys, there often remains latent heat of solidification to be removed from the melded strip 26. This remaining latent heat of solidification is removed by the spray mist cooling system 43 including a bank of nozzles 45 located near the melded strip 26 and positioned closely below the bite region. There is a source 47 of water under pressure which is fed through a pipe line 49 and through a flow control valve 51 to the respective nozzles 45. There is also a source 53 of compressed air which is fed through another pipe line 55 and through another flow control valve 57 to the respective nozzles 45. At the nozzles 45, the pressurized air and pressurized water are mixed, and the flow control valves 51 and 57 are employed to regulate the total rate of spray mist cooling and to regulate the ratio of air-to-water at the nozzles 45 for controlling the droplet size for optimizing the cooling effect. The water used in the source 47 is distilled or deionized for avoiding staining of the surface of the melded strip 26. It is to be understood that a second spray mist system identical with the system 43 can be used for cooling the opposite surface of the melded strip 26.

Unlike other two-drum continuous casting processes, there is no injector nozzle to shape and control the formation of the final melded strip 26. The metal 24 is flowed at controlled velocity 21 toward the surface 22 of each drum at a level close to but not more than slightly above the horizontal level of the drum crest. The liquidous/solidous metal is pulled forward from a shallow pool 24 in a horizontal flat open launder 28 of a width sliqhtly qreater than the desired width of the finished strip 26. The edges of the resulting melded strip 26 can be trimmed off if desired. Each drum surface 22 is travelling at a speed faster than the controlled flow velocity 21 in the shallow launder 28, at least 1.5 times as fast, for pulling a thin layer 10 and 12 of liquidous/solidous metal forward on each drum surface significantly faster than the controlled velocity 21, thereby significantly thinning the pulled layer of metal as it makes the transition from each shallow launder 28 onto the faster travelling drum surface 22, as shown clearly in FIG. 6.

Figure 6:
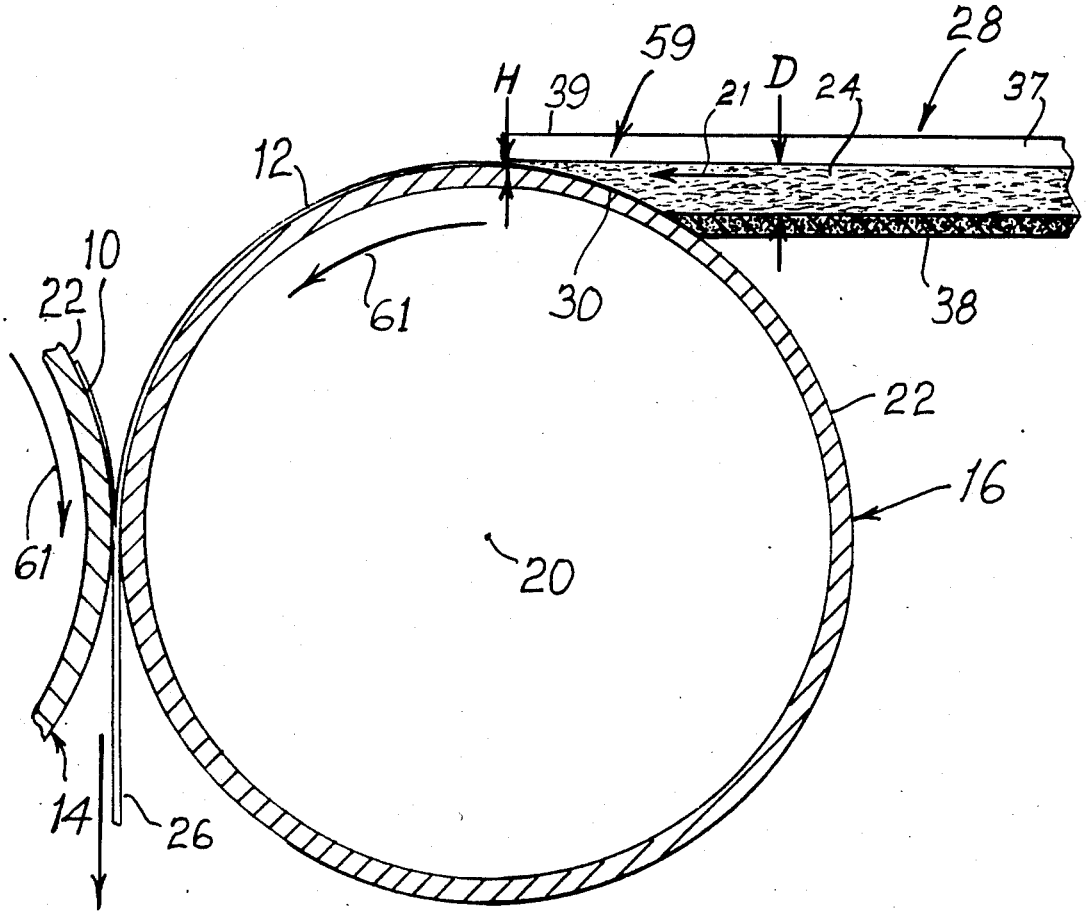
FIG. 6 is an enlargement of a portion of FIG. 5 for purposes of explaining certain relationships which are critical to a full understanding of the present invention.

Each launder 28 is closely fitted at 30 on each side 36, 37 (and closely on the bottom 38 as seen in FIG. 6) to the curvature of the adjacent drum (for example, 10 to 24 inches in diameter). Each launder 28 is open to and fed from an outer pool 31 of molten metal maintained at a constant level by supplying molten metal as shown by the flow arrows 33 at a constant volume per unit of time flow rate into the pool 31 through a channel 32. From each outer metal pool 31 the metal flows under the lower lip of a barrier wall 40 for holding back any dross and then enters the respective inner pool 24.

Figure 3:
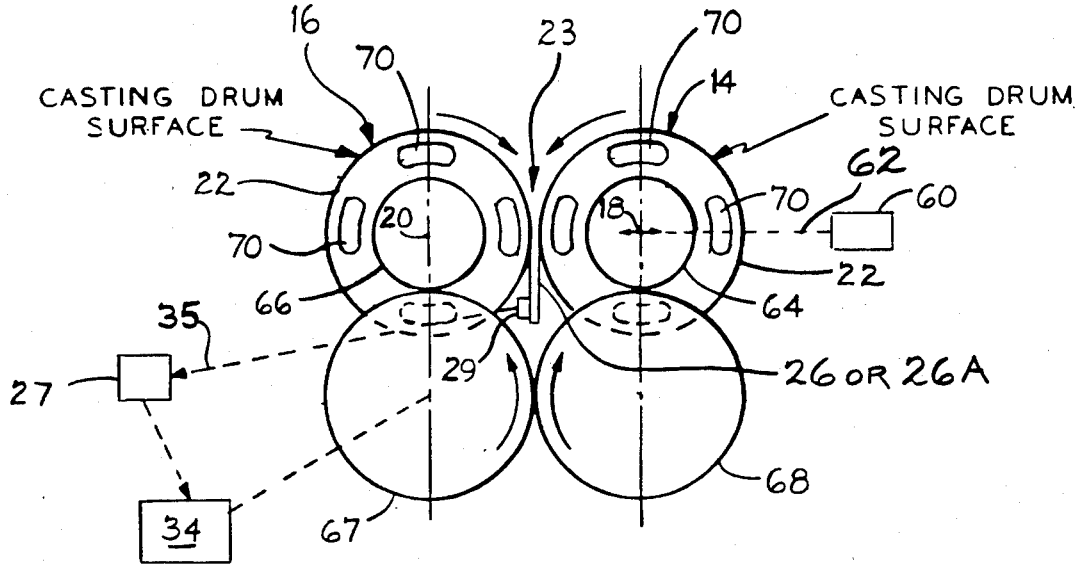
FIG. 3 shows the drive gear arrangement for the two drums at their partially closed ends and the speed control arrangement.

The thickness of metal in the bite and thus the precise gauge of the finished melded strip 26 is controlled through speed control apparatus 27 (FIG. 3) by controlling the speed of rotation of the drums and the spacing in the bite between the drums, sometimes called the roll gap. When the drums' rotation speed is increased and their spacing in the bite 23 is decreased, the thickness of the layers 10 and 12 being pulled forward from the shallow pool 24 by the faster travelling drum surfaces 22 is reduced, although the volume per unit of time remains the same. Conversely, when the drums' rotational speed is decreased and their bite spacing is increased, the thickness of these layers being pulled forward by the drum surfaces is increased. Gauge control of the strip 26 is automated by a suitable commercially available gauge control 27. For example, such control 27 may use optical, mechanical, pressure, magnetic or other devices to sense conditions in the bite or take readings from the cast finished strip 26. The sensor 29 provides a signal 35 for the variable speed control 27 for the electric driving motor 34 (FIG. 3).

Thus, the injector nozzle of the prior art is avoided by direct forming of the layers 10, 12 and melded strip 26 by the sides 36 and 37 of the launders 28 closely fitting at 30 to the drums and by the rate of travel of the surfaces of the drums and the dimensions of the bite 23. The top edges 39 of the launder sides 36 and 37 are at least about $\frac{1}{2}$ inch to $\frac{3}{4}$ inch above the level of the crest of the associated drum. This method and apparatus make the metal casting easier than prior art continuous casting processes and facilitate automation of gauge control.

The present method and apparatus also make the start of casting easier and safer than prior art two-drum continuous casting processes by eliminating the injector nozzle which they require.

Figure 4:
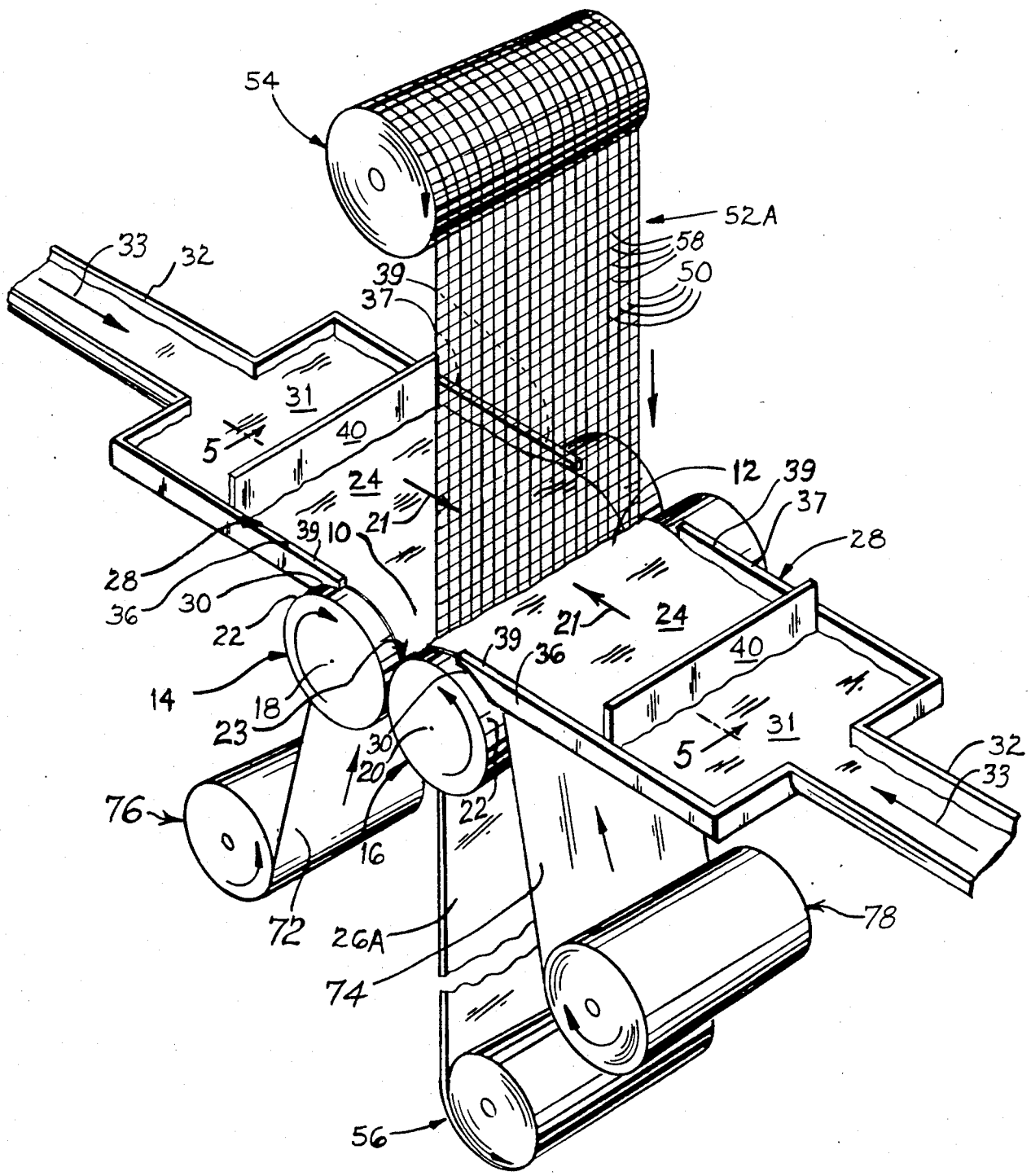
FIG. 4 is a perspective view similar to FIG. 1 showing a second embodiment of the two-drum, two-layer continuous meldcasting method and apparatus of this invention for applying cladding layers to the meld-cast strip product.

When starting a prior art two-drum continuous casting process it is necessary, in order to prevent freeze-ups or overflows, for two of three men to maintain careful vigilance over the position of the nozzle and the free flow of metal through it. This requires them to work in close proximity to the hot rolls and molten metal. When starting casting with the present method and apparatus, the drums are rotated at a speed higher than that required to obtain melding in the bite at the preset roll gap. Then the rotational speed is gradually reduced so that the thicknesses of the two solidifying layers increase and they begin to meld in the bite for producing the melded strip 26 and 26A (FIG. 4). Thereafter, the rotational speed is held relatively constant at the desired value for producing melded strip 26 and 26A. This system of starting permits the operator to remain safely remote from the hot rolls and molten metal.

Furthermore, the present method and apparatus permit thinner castings than prior continuous casting processes, and such thinner as-cast gauge is desirable for economic reasons as described above. Such thinner casting is partly achieved by increasing the speed of rotation of the drums or reducing the rate of flow 31 of the molten metal flowing through channel 32, but it is also facilitated by designing the drums 14 and 16 to permit drum surface temperatures from 100° C. up to 400° C. High drum surface temperatures are desirable for forming thin liquidous/solidous layers 10, 12 by avoiding premature solidification in these layers 10, 12 on the travelling drum surface. Prior art continuous casting processes use water cooling inside closed drums or segmented molds or on the back of casting belts. This water cooling causes the surface in contact with the molten metal to not be appreciably hotter than 100° C.

Figure 2:
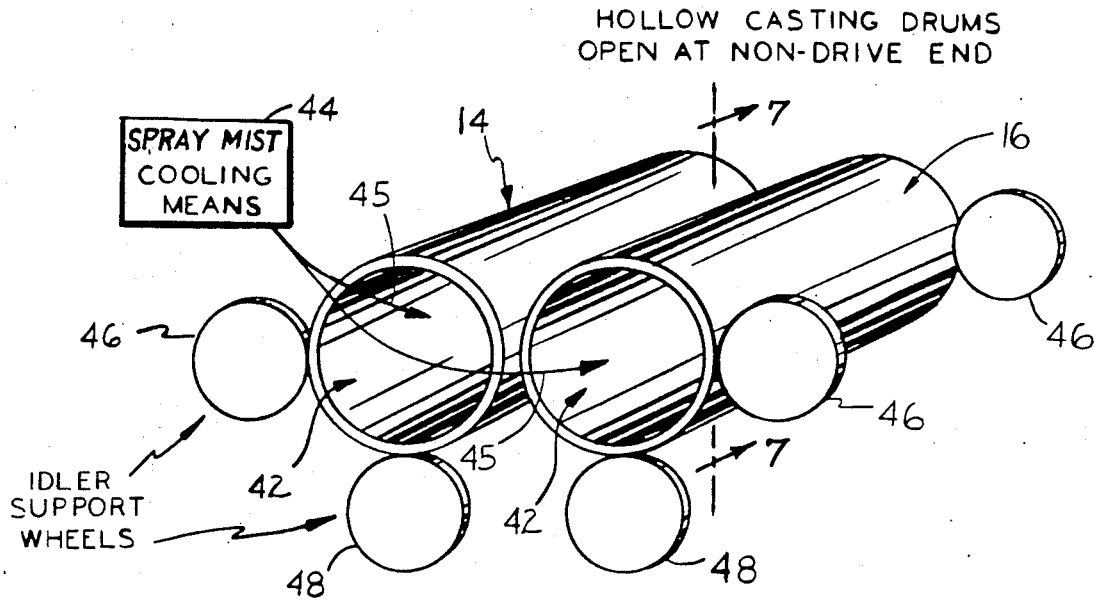
FIG. 2 is a perspective view showing the supports for the two revolving hollow drums at their respective open ends and illustrating the spray mist cooling means for controllably cooling the interiors of the two hollow drums.
Figure 7:
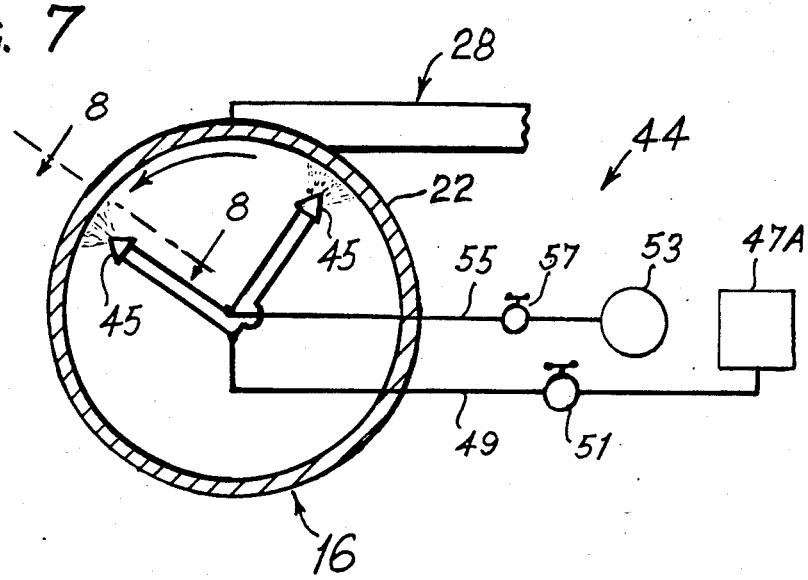
FIG. 7 is an enlarged cross-sectional view of one of the hollow drums of FIG. 2, being a section taken on the line 7—7 in FIG. 2, showing a spray mist cooling system.
Figure 8:
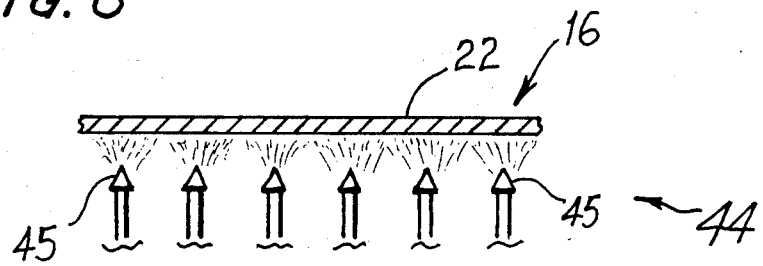
FIG. 8 is a partial axial sectional view taken along the line 8—8 in FIG. 7 showing further aspects of the spray mist cooling system.

In the present invention, drums 14 and 16 are used which are hollow (FIGS. 2, 7 and 8) with one open end and rotationally driven at the other, partially closed end. This use of two hollow drums with the support and drive arrangement as shown in FIGS. 2 and 3, permits insertion at the open ends 42 of spray mist cooling means 44, for example, including banks of spray mist nozzles 45 similar to those in the spray mist cooling system 43 shown in FIG.1, except that the water in the pressurized water source 47A need not be distilled nor deionized. The advantage of this spray mist cooling system 44 with its two banks of nozzles 45 inside of each hollow drum is that the droplet size and volume of cooling mist per unit time are readily controllable by the valves 51, 57 for achieving an external drum surface temperature at any desired value in the range from 100° C. up to 400° C. The droplet size is adjusted to obtain complete evaporation of the droplets off from the internal drum surface in one full revolution of the drum, so as to maintain the temperature of the drum surface at the level desired below solidification temperature of the molten metal 24. Steam generated is exhausted readily from one or both ends of each drum. The peripheries of the drums are supported at the open (non-drive) end or at both ends by groups of non-driven idler wheels 46 and 48 to maintain precise alignment of their axes. An important advantage of this spray mist cooling method and apparatus is that use is made of the latent heat of vaporization of the cooling water which is five to ten times greater per pound than the latent heat of fusion of most metals.

It is impossible to do this vaporisation cooling with belt type continuous casting systems, because of belt distortion problems. It is also impossible to do this vaporisation cooling with closed drum or segmented mold continuous casting systems, because there is no outlet for the resultant steam generated. With the present method and apparatus the steam generated can escape through the open ends 42 (FIG. 2) and also through apertures or ports 70 (FIG. 3) at the drive ends of the drums. By using the latent heat of vaporisation of the cooling water, it is possible to reduce greatly the amount of cooling water, which reduction in water volume provides substantial capital and operating cost economies.

Double drum casting processes as known in the prior art which are fed by a single stream of metal require a very careful control of the temperature and position of the solidification zone. This criticality in prior art processes is one of the reasons for the use therein of injector nozzles. Control of the temperature and position of the solidification zone is advantageously not critical with the present method and apparatus, because the two layers 10 and 12 can be melded together over a relatively wide range of solidification states and any remaining latent heat of solidification in the melded strip 26 and 26A can be removed by spray mist cooling systems 43 located closely below the bite region 23.

With the present method and apparatus, it is not necessary to use an injector nozzle, as described above. This avoidance of need for an injector nozzle makes much easier and more convenient the introduction of reinforcing constituents 50, whether in filament or whisker form. Reinforcing filaments 50 are added in collimated array 52 or a reticulated network 52A (FIG. 4). Such an array or network 52, 52A would be extremely difficult to pass intact through a prior art injector nozzle. Maintaining the array or network 52, 52A is advantageously relatively convenient with the present method and apparatus, because the array or network 52, 52A can be kept under tension from the filament array payoff device 54 to the bite 23 and under tension to the coiling apparatus 56 for the composite strip 26 or 26A in coil form.

Reinforcing constituents in whisker form may be added in the metal pools 31 or 24 or can be sprinkled onto the webs 10 and 12 or into the bite region 23, as shown by the arrow 59 in FIG. 6, depending upon the metal and whisker combination being used. It is difficult to pass such a mixture of whiskers and metal through a prior art injector nozzle.

By substituting a solid or reticulate web 52A for the colliminated array of filaments 52 laminates with the meld-cast material on the outside are produced.

As shown in FIG. 4, laminates or clad materials 26A can advantageously be produced with the meld-cast metal on the inside different from the cladding material on the outside. Such sheet laminates or clad sheet materials 26A are made by feeding a solid or reticulate web 72 and 74, respectively, from a pay off device 76 and 78, respectively, located below one or both launders 28 onto one or both drums 14 and 16 and allowing the flowing metal 24 being cast to contact and adhere to the solid or reticulate web as it travels in contact with the surface 22 of the respective drum over towards the crest. The clearance between the bottom 38 of each launder 28 and the surface of the drum is sufficient to allow the upwardly travelling solid or reticulate web 72 or 74 to pass between the launder and the drum surface with the web 72 or 74 in contact with the drum surface and with a close fitting relationship between the web 72 or 74 and the bottom of the adjacent launder. Tension is applied to the webs 72 and 74 for preventing distortion and for maintaining the upwardly travelling web in position as it approaches the drum surface.

As shown in FIG. 3, there are gears 64 and 66 fixed concentrically to the ends of the respective drums 14 and 16. A pair of meshing rotating drive gears 67 and 68 are driven by the motor 34, whose speed is controlled by the control 27, as explained above. The spacing in the bite 23 between the revolving drums 14 and 16 is controlled by allowing the shifting of the axis 18 of the drum 14 horizontally by means of a mechanical linkage 62 operated by a resilient pneumatic cylinder and piston unit 60. Alternatively, the resiliency for allowing the bite 23 to accommodate the melding of the two layers 10 and 12 is provided by a spring 60. At their driven ends, as shown in FIG. 3, the two drums may include a plurality of apertures 70 for allowing steam to escape.

Examples of aluminum and aluminum alloy sheet products 26 which can be made with the present invention include aluminum siding and awning stock, gutter and down spout stock, fascia and roofing sheet, damp course (vapor barrier), can stock and lamp base stock, stock for making seam welded tubing for furniture and other applications, stock for making roll formed profiles including TV antenna tubing, window, door and structural sections, stock for impact extrusion slugs.

Examples of lead or lead alloy sheet products 26 which can be made with the present invention include wine bottle capping stock, sound proofing sheet, electric storage battery stock. Tin sheet product 26 includes stock for impact extrusion slugs and plating other materials. Zinc and zinc alloy products 26 which can be made with the present invention include roofing sheet and stock for drawn products.

The reinforcing strands 50 and reticulate networks 52A of strands, and strands 50 of suitable metals or ceramics are shown being introduced into the solidifying web 26. Metal or ceramic whiskers 59 (FIG. 6) can also be introduced into the molten pools 31 or 24 as described above. Such reinforcing agents increase the tensile strength or the modulus of elasticity or both of the cast, reinforced web 26 far above the strength or modulus of the matrix metal 24 containing such reinforcement. Such combinations of materials are termed metal matrix composites.

Aluminum metal matrix sheet composites 26 use alumina, boron, graphite, silicon carbide, silicon nitride, steel and its alloys as well as other materials resistant to elevated temperatures, as reinforcing agents 50 or reticulated networks 52A or as reinforcing whiskers. The resulting composite web 26 is primarilY used in the aerospace and aviation industries for structural members to reduce aircraft weight.

By introducing steel wires 50 in an array 52 or a reticulated network 52A or steel whiskers 52 into an aluminum matrix 24 with the present invention, it is possible to achieve tensile strengths higher than aircraft alloys such as AA7075 and a modulus of elasticity 50 percent or more higher than any existing aluminum alloy. Steel (and its alloys) is the cheapest of the available reinforcing agents 50 and the present cheap process for making steel reinforced aluminum matrix sheet composite 26, 26A will open commercial markets for such sheet composites. Examples of commercial applications of steel reinforced aluminum matrix sheet composites include automotive bumpers, highway guard railing, structural tubing and sections. Aluminum matrix sheet composite 26, 26A can advantageously contain expensive reinforcing agents 50 such as boron, graphite and ceramics and be produced more cheaply with the present invention as compared with production by prior art batch processes, and thus will become more widely used in the aerospace and other industries.

Lead matrix sheet composite 26 reinforced with a steel reticulate web 52 are made with the present invention. Such a reinforced lead sheet product 26 is non-sagging and creep resistant and can be used for sound proofing in vertical walls or in roofing and in chemical containers. Copper wire 50 cast into lead battery sheet stock 26 advantageously reduces the internal resistance of the battery.

Laminated or clad sheet products 26, 26A are produced by introducing an array 52 or solid or reticulate webs 52A of materials other than the matrix material 24, between the two layers 10, 12 being cast. Alternatively, other combinations of laminated or clad sheet products 26A (FIG. 4) are produced by introducing solid or reticulate cladding webs 72, 74 on the outside of one or both of the layers 10, 12 being melded together.

An aluminum alloy matrix 24 clad on the outside with high purity aluminum 72, 74 is used to make sheet product 26A for applications requiring a combination of strength and corrosion resistance or brightness, such as light reflectors or automotive and appliance trim. Aluminum brazing sheet 26A requires a cladding of an alloy 72, 74 with a lower melting point than that of the matrix alloy 24.

The surfaces 22 of one or both casting drums 14, 16 can be engraved with an attractive pattern or a utilitarian grid pattern, then the surface of the respective cast web 10, 12 is shaped to that engraved pattern. By this means decorative patterns are obtained on the cast product 26 (FIG. 1), for example, such as wood grain for aluminum siding 26. Alternatively, patterns such as reinforcing ribs are produced in the cast sheet 26 to increase denting resistance or the moment of inertia of a structural tube or section which has been roll formed from the ribbed sheet 26.

Inviting attention to the spray mist cooling system 43 (FIG. 1) and 44 (FIGS. 2, 7 and 8), the spray mist nozzles 45 in the respective banks of such nozzles are uniformly spaced apart horizontally by about two to four inches on centers.

As shown in FIG. 4, the reticulated reinforcing network 52A may include longitudinal reinforcing strands, fibers, wires, filaments, or other elements 50 together with transverse strands, fibers, wires, filaments or other elements 58 arrayed in a mesh.

FIG. 6 clearly shows certain relationships which are critical in practicing the present invention.

Figure 5:
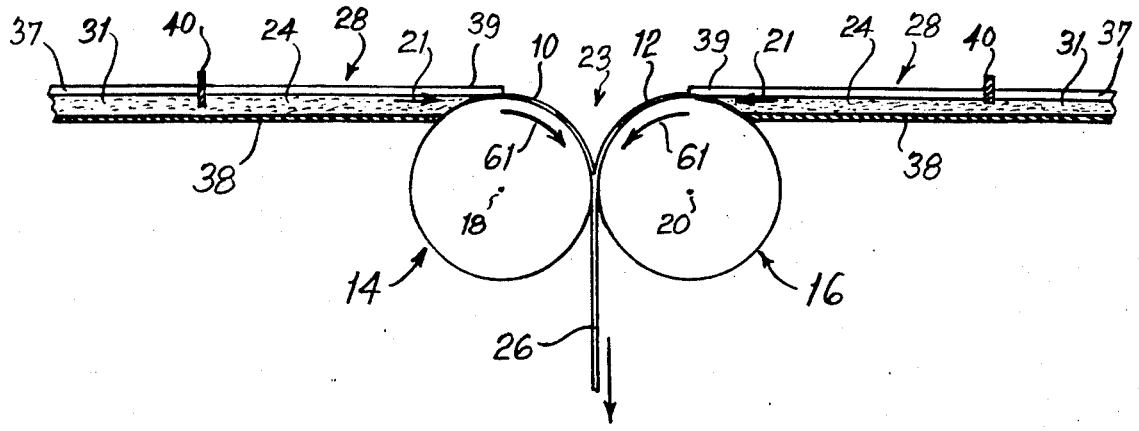
FIG. 5 is an elevational sectional view taken along the line 5—5 in FIG. 1.

1. The speed of revolution of the drums 14 and 16, as shown by the arrows 61 (See also FIG. 5) produces a drum surface speed which is at least 1.5 times the controlled flow velocity 21 of the molten metal at the discharge end of the launder 28 immediately adjacent to the drum crest.

It is to be noted that as used throughout this specification, the term "controlled flow velocity" as indicated by the flow arrows 21 in the respective launders 28 is intended to mean the metal flow velocity at the very discharge (downstream) end of the launder immediately adjacent to the drum crest.

2. The flowing molten metal in each shallow launder 28 is relatively shallow, preferably having a maximum depth D (FIG. 6) no more than about 0.6 of an inch.

3. The flowing molten metal 24 in each launder is travelling immediately adjacent to the crest, as shown by the arrows 21 (FIGS. 5 and 6), in the same direction as the surface 22 of the associated drum 14 or 16 at the crest of the drum.

4. The top surface of the molten metal 24 is at a level close to but not more than about ⅛th of an inch above to 1/16th of an inch below the horizontal level of the crest of the drum. In FIG. 6, the top surface of the metal 24 is shown to be at a height "H" above the horizontal level of the drum crest. A typical value of H would be about 1/16th (0.0625) of an inch above the level of the drum crest.

5. When the drum surface 22 is travelling twice as fast as the flow velocity 21 at the discharge end of the launder immediately adjacent to the drum crest, the liquidous/solidous layer 10 or 12 which is pulled forward from the end of the launder by the faster travelling drum surface 22 has a thickness of about one-half of H, namely, about 0.0313 of an inch. The resultant melded strip 26 then has a thickness of about 1/16th of an inch. In other words, depending upon the ratio "N" of drum surface speed to the flow velocity 21 in the discharge end of the launder immediately adjacent to the drum crest, the following thicknesses of the layer 10 or 12 are produced:

| N | H (Inches) | Thickness of Layer 10 or 12 (Inches) |
|---|---|---|
| 1.5 | 0.06 | 0.04 |
| 2.0 | 0.06 | 0.03 |
| 3.0 | 0.06 | 0.02 |
| 4.0 | 0.06 | 0.015 |
| 5.0 | 0.06 | 0.012 |
| 6.0 | 0.06 | 0.01 |

6. It is preferred to have the level of the molten metal 24 slightly above the drum crest, because that height "H" prevents the dendrites forming on the drum surface 22 from punching through the outer surface of the layer 10 or 12. This height H of molten metal is continually supplying forward moving liquidous metal onto the fast travelling drum surface for preventing "drain down" and subsequent dendrite punch through, which produces the roughened surface described in British Pat. No. 1,354,771. Such dendrite punch through is not desired in the practice of the present invention, because the resultant rough outer surface on the layer 10 or 12 can produce undesired porosity in the center of the melded strip 26 or 26A.

7. It is possible for the surface of the molten metal 24 to be very slightly (not more than 1/16th of an inch) below the horizontal level of the drum crest when the drum speed 61 is relative ly fast (for example "N" of three or more), i.e., so fast that the frictional drag and impelling action of the fast-travelling drum surface 22 continues to pull a sufficient uniform flow of liquidous metal forward into the layer 10 or 12 for preventing dendrite punch through.

It is foreseen that many applications can be satisfied by the present method and apparatus by direct meld casting of two layers of liquidous/solidous metal to the desired gauge using foundry alloys if necessary to achieve the properties required. Some applications will require work hardening reduction which can be limited to the rolling reduction required to meet the gauge and property requirements.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

I claim:

1. The method of meld-casting metallic strip from molten metal comprising the steps of:

providing two closely spaced drums with parallel horizontal axes defining a bite region between them, revolving said drums in opposite directions at approximately the same surface speed with each drum moving downwardly in the bite region, cooling said drums for maintaining the drum surfaces below the solidification temperatures of said molten metal, flowing the molten metal in two shallow pools at controlled velocity in each pool toward the crest of the respective drum with the level of the top surface of the flowing metal being close to the horizontal level of the crest of the drum, the metal flows in the respective shallow pools being in opposite directions flowing toward each other toward the crest of the respective drum, causing each drum surface to travel at least 1.5 times the flow velocity in the respective pool immediately adjacent to the crest of the drum for forming thin solidifying layers of liquidous/solidous metal being carried from the crests of the respective drums down toward the bite region, and melding together in the bite region said two solidifying layers forming a resulting meld-cast strip moving downwardly from the bite region below the bite region.

2. The method of continuously meld-casting metallic strip as claimed in claim 1, including the steps of:

providing a pair of hollow drums, cooling the interior surfaces of said drums by applying spray mist of mixed air and water for maintaining the outer surfaces of said drums at a temperature in the range from 100° C. to 400° C.

3. The method of continuously meld-casting metallic strip, as claimed in claim 1, including the step of:

spacing the drum surfaces in the narrowest portion of the bite region in the range from 0.01 of an inch to 0.30 of an inch.

4. The method of continuously meld-casting metallic strip as claimed in claim 3, including the step of:

introducing an array of reinforcement elements moving downwardly into the bite region for inclusion of said reinforcement elements in the melded strip.

5. The method of continuously meld-casting metallic strip, as claimed in claim 3, including the step of:

introducing reinforcing whiskers into the bite region for inclusion in the resultant melded strip for reinforcing the strip.

6. The method of continuously meld-casting metallic strip as claimed in claim 5, including the step of:

sprinkling reinforcing whiskers onto at least one liquidous/solidous layer being carried by the drum surface for introducing whiskers into the bite region for inclusion in the resultant melded strip for reinforcing the strip.

7. The method of continuously casting metallic strip, as claimed in claim 3, including the step of:

introducing a web of another material moving downwardly into the bite region for laminating said web of another material between and onto the two layers being melded together, and applying tension to said web of another material to maintain its position and avoid its distortion.

8. The method of continuously meld-casting metallic strip, as claimed in claim 3, including the step of:

introducing a web of another material travelling upwardly between one rising drum surface and the layer of solidifying liquidous/solidous metal flowing from the shallow pool toward the drum surface near the crest of the drum, carrying said web on the drum surface travelling over the crest and down through the bite region for laminating said web of another material onto one of the outer surfaces of the melded strip, and applying tension to said web of another material as it approaches the rising drum surface to maintain its position and avoid its distortion.

9. The method of continuously meld-casting metallic strip, as claimed in claim 3, including the step of:

feeding a first layer of cladding material upwardly in contact with one upwardly travelling drum surface, carrying said cladding material on the drum surface travelling over the crest of the drum and downwardly through the bite region.

feeding a second layer of cladding material upwardly in contact with the other upwardly travelling drum surface, carrying said second cladding material on the other drum surface travelling over the crest of the other drum and downwardly through the bite region, flowing molten metal from the respective shallow pools onto the respective travelling layers of cladding material near the respective drum crests forming a layer of liquidous/solidous material on each travelling layer of cladding material, and melding together in the bite region said two liquidous/solidous metal layers for forming a melded strip with said cladding layers on the outside surfaces of the strip.

10. The method of continuously meld-casting metallic strip, as claimed in claim 3, including the step of:

engraving the outer surface of at least one of said drums, and thereby meld-casting a pattern onto at least one of the outer surfaces of the melded strip.

11. The method for starting the meld-casting method as claimed in claim 3, comprising the steps of:

establishing a predetermined gap spacing between the drums in the bite in said range of 0.01 of an inch to 0.30 of an inch, initially revolving both drums at surface speed faster than that which produces layers of solidifying liquidous/solidous metal which are too thin for obtaining their melding in the bite region for said predetermined gap spacing in the bite between the two revolving drums, gradually reducing the drum surface speed for gradually increasing the thicknesses of said two layers of solidifying liquidous/solidous metal until these two layers meld together in the bite region for forming the melded strip, and thereafter holding the surface speed of the two drums at a constant speed for continuing to produce the melded strip.

12. The method of continuously meld-casting metallic strip as claimed in claim 3, including the steps of:

locating the level of the top surface of the molten metal in the resepctive pool within the range of about ⅛th of an inch above to about 1/16th of an inch below the horizontal level of the crest of the respective drum surface.

13. The method of continuously meld-casting metallic strip as claimed in claim 12, wherein:

the depth of the flowing molten metal in each shallow pool is no more than 0.6 of an inch deep.

14. The method of continuously meld-casting metallic strip, as claimed in claim 12, including the step of:

introducing reinforcing whiskers into at least one of said shallow pools for reinforcing the melded strip.

15. The method of continuously meld-casting metallic strip, as claimed in claim 12, including the step of:

feeding an array of collimated reinforcing strands downwardly into the bite region for inclusion of said strands in the melded strip, and applying tension to said strands for holding them in their array.

16. The method of continuously meld-casting metallic strip, as claimed in claim 12, including the step of:

feeding a reticulated network of reinforcing elements downwardly into the bite region for embedding said network into the melded strip, and applying tension to said reticulated network for avoiding its distortion and for maintaining its position between said two layers of liquidous/solidous solidifying metal on the drum surfaces.

17. The method of continuously meld-casting metallic strip, as claimed in claim 12, including the steps of:

decreasing the thickness of the liquidous/solidous layers of metal being carried into the bite region by the surfaces of said drums by increasing the revolving sped of said drums and decreasing their bite spacing while maintaining constant the volume flow rate of molten metal per unit of time in said shallow pools for meld casting in the bite region a thin strip in said range of 0.01 to 0.30 of an inch, and increasing the thickness of the liquidous/solidous layers of metal being carried into the bite region by the surfaces of said drums by decreasing the revolving speed of the drums and increasing their bite spacing while maintaining constant the volume flow rate of molten metal per unit of time in said shallow pools for meld casting in the bite region a thicker strip in said range.

* * * * *